US012004663B2

(12) United States Patent
Hough et al.

(10) Patent No.: US 12,004,663 B2
(45) Date of Patent: Jun. 11, 2024

(54) CHAIR APPARATUS

(71) Applicant: L2 Furniture, LLC, McDonough, GA (US)

(72) Inventors: Lawrence Hough, McDonough, GA (US); Leonte Benton, McDonough, GA (US)

(73) Assignee: L2 Furniture, LLC, McDonough, GA (US)

( * ) Notice: Subject to any disclaimer, the term of this patent is extended or adjusted under 35 U.S.C. 154(b) by 0 days.

(21) Appl. No.: 17/851,352

(22) Filed: Jun. 28, 2022

(65) Prior Publication Data

US 2023/0414003 A1 Dec. 28, 2023

(51) Int. Cl.

| | |
|---|---|
| ***A47C 7/62*** | (2006.01) |
| ***A47C 1/032*** | (2006.01) |
| ***A47C 7/70*** | (2006.01) |
| ***A47C 7/72*** | (2006.01) |

(52) U.S. Cl.

CPC ..... *A47C 7/70* (2013.01); *A47C 1/03255* (2013.01); *A47C 7/72* (2013.01); *A47C 7/62* (2013.01)

(58) Field of Classification Search

CPC ..... A47C 7/70

USPC .... 297/162, 188.01, 188.04, 188.06, 188.07, 297/188.08, 188.12, 188.13

See application file for complete search history.

(56) References Cited

U.S. PATENT DOCUMENTS

| | | | | | |
|---|---|---|---|---|---|
| 564,044 | A * | 7/1896 | Berkemeyer | A47C 7/70 | 297/170 |
| 1,391,222 | A * | 9/1921 | Van Fleet | A47B 83/02 | 297/170 |
| 3,265,436 | A * | 8/1966 | Nelson | A47C 7/70 | 297/150 |
| 3,567,277 | A * | 3/1971 | Van | A47C 7/70 | 297/162 |
| 3,712,668 | A * | 1/1973 | Fink | A47C 1/124 | 297/162 X |
| 4,136,908 | A * | 1/1979 | Crayne | A47C 1/11 | 297/188.21 |
| 4,645,167 | A * | 2/1987 | Hardwick | B63B 29/04 | 297/188.21 X |
| 5,022,706 | A * | 6/1991 | Bryan | A47C 9/02 | 297/145 |
| 5,110,184 | A * | 5/1992 | Stein | A47C 7/008 | 297/188.04 X |

(Continued)

*Primary Examiner* — Rodney B White

(74) *Attorney, Agent, or Firm* — BEKIARES ELIEZER LLP

(57) ABSTRACT

Elements of the present disclosure provide chair apparatus comprising: a seat comprising: a top portion configured to contact at least a portion of a user of the chair apparatus, and a bottom portion; a back support secured to the bottom portion, the back support configured to contact at least a portion of the user of the chair apparatus; a chair base comprising: a cylinder, a first end of the cylinder securing to the bottom portion of the seat, a cylinder base secured to a second end of the cylinder, one or more legs secured to the cylinder base; a table system comprising: a table arm revolvably secured to the cylinder such that the table arm is configured to axially rotate independently and undisturbed around the seat and the back support, and a table portion hingedly connected to the table arm and positioned above the top portion of the seat.

18 Claims, 10 Drawing Sheets

(56) References Cited

U.S. PATENT DOCUMENTS 5,169,210 A * 12/1992 Fricano ..... A47C 7/70 297/188.21
5,269,157 A * 12/1993 Ciminelli ..... A45C 5/14 297/188.04 X
5,326,152 A * 7/1994 Baron ..... A47C 31/11 297/188.04 X
5,653,499 A * 8/1997 Goodall ..... A47B 83/02 297/173
5,765,911 A * 6/1998 Sorenson ..... A47C 7/70 297/162 X
5,845,964 A * 12/1998 Phoon ..... A47C 7/70 297/162 X
6,053,570 A * 4/2000 Stern ..... A47C 7/62 297/188.01
6,224,149 B1 * 5/2001 Gevaert ..... A47C 7/70 297/162
6,237,997 B1 * 5/2001 Olson ..... A47C 7/70 297/162
6,422,646 B1 * 7/2002 McNally ..... A47C 7/70 297/161
6,776,452 B2 * 8/2004 Onishi ..... A47C 7/68 297/188.21
6,976,733 B1 12/2005 Biederman et al.
7,293,751 B2 11/2007 Eriksson
7,311,354 B2 * 12/2007 Giasson ..... B64D 11/064 297/145
7,878,585 B2 * 2/2011 Salisbury ..... A47C 7/744 297/180.14
8,002,349 B1 8/2011 Pizzuto
8,141,948 B2 * 3/2012 Cassellia ..... B60K 35/00 297/217.3
8,152,234 B2 * 4/2012 Terleski ..... B64D 11/06 297/188.04
8,197,000 B1 * 6/2012 Cohen ..... A47C 7/622 297/188.04
8,696,056 B2 * 4/2014 Corcorran ..... A47C 7/70 297/173
8,794,699 B1 * 8/2014 Rudolfo ..... A47C 4/20 297/162 X
8,870,281 B1 * 10/2014 Boone ..... A47C 7/746 297/180.11
9,044,099 B2 * 6/2015 Bouche ..... A47C 7/626
9,277,825 B2 * 3/2016 Corcorran ..... F16M 11/22
9,693,625 B2 * 7/2017 Lu ..... A47C 7/626
9,904,917 B2 2/2018 Ruggiero et al.
9,962,003 B2 * 5/2018 Corcorran ..... A47C 7/62
10,045,627 B2 * 8/2018 Simon ..... A47C 7/68
10,264,893 B2 * 4/2019 Keilhauer ..... A47C 7/006
10,966,534 B2 * 4/2021 Keilhauer ..... A47C 7/68
11,166,563 B2 * 11/2021 Chen ..... A47B 39/00
2004/0066065 A1 * 4/2004 Forstner ..... B64D 25/16 297/188.08
2005/0140186 A1 * 6/2005 Piretti ..... A47C 7/70 297/162
2005/0248189 A1 * 11/2005 Prasatek ..... B60N 2/64 297/188.04
2006/0006705 A1 * 1/2006 Charbonneau ..... A47C 7/62 297/188.08
2008/0231091 A1 * 9/2008 Goranson ..... A47C 7/62 297/135
2011/0187164 A1 * 8/2011 Corcorran ..... F16M 11/22 248/163.1
2014/0021750 A1 * 1/2014 Su ..... A47C 7/70 297/162
2015/0224003 A1 * 8/2015 Allen ..... A61G 5/1094 297/188.06
2015/0241041 A1 * 8/2015 Youngberg ..... A47C 7/68 108/150
2016/0338495 A1 * 11/2016 Purintun ..... A47C 7/70
2018/0110335 A1 * 4/2018 O'Hagan ..... A47C 7/66

* cited by examiner

CHAIR APPARATUS

FIELD OF DISCLOSURE

The present disclosure generally relates to chairs, tables, and workstations.

BACKGROUND

In some situations, the ability to work from a variety of places is desired. For example, when working from a coworking space or dynamic work environment, the ability to have seating, charging ability, and table for is needed for working proficiently. Thus, the conventional method is stationary modular workstations which may include the aforementioned components. This often causes problems because the conventional strategy does not account for the desire of said workstation to be easily mobile, movable, and collapsible. An improved chair, table, charger combination that is easily movable is desired.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

In one aspect, the present disclosure relates to the present disclosure provide a chair apparatus comprising: a seat comprising: a top portion configured to contact at least a portion of a user of the chair apparatus, and a bottom portion; a back support secured to the bottom portion of the seat, the back support configured to contact at least a portion of the user of the chair apparatus; a chair base comprising: a cylinder, a first end of the cylinder securing to the bottom portion of the seat, a cylinder base secured to a second end of the cylinder, one or more legs secured to the cylinder base, the one or more legs being configured to support the chair apparatus and to contact an operable surface for use of the chair apparatus; a table system comprising: a table arm revolvably secured to the cylinder such that the table arm is configured to axially rotate independently and undisturbed around the seat and the back support, and a table portion hingedly connected to the table arm and positioned above the top portion of the seat.

In another aspect, the present disclosure relates to a chair apparatus comprising: a seat secured to a back support, the seat and the back support each configured to contact at least a portion of a user of the chair apparatus; and a chair base secured to the seat, the chair base comprising: one or more legs configured to support the chair apparatus and to contact an operable surface for use of the chair apparatus, and a table system comprising: a table arm revolvably secured to the chair base such that the table arm is configured to axially rotate undisturbed around the seat, and a table portion hingedly connected to the table arm and positioned above the seat, wherein the back support comprises a power source configured to provide electrical output to one or more external electronic devices.

In another aspect, the present disclosure relates to a chair apparatus comprising: a seat comprising: a top portion configured to contact at least a portion of a user, and a bottom portion; a back support secured to the bottom portion of the seat; a chair base comprising: a gas cylinder, a first end of the gas cylinder securing to the bottom portion of the seat, a cylinder base secured to a second end of the gas cylinder, a cylinder cover enveloping at least a portion of the gas cylinder, and one or more legs secured to the cylinder base; and a table system comprising: a table arm revolvably secured to the cylinder cover such that the table arm is configured to axially rotate undisturbed around the seat and the back support, the table arm comprising: a telescoping table system height adjustor configured to adjust vertical position of the table system in relation to the seat and the back support, a telescoping table system length adjustor configured to adjust horizontal position of the table system in relation to the seat and the back support, and a table portion hingedly connected to the table arm and positioned above the top portion of the seat.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
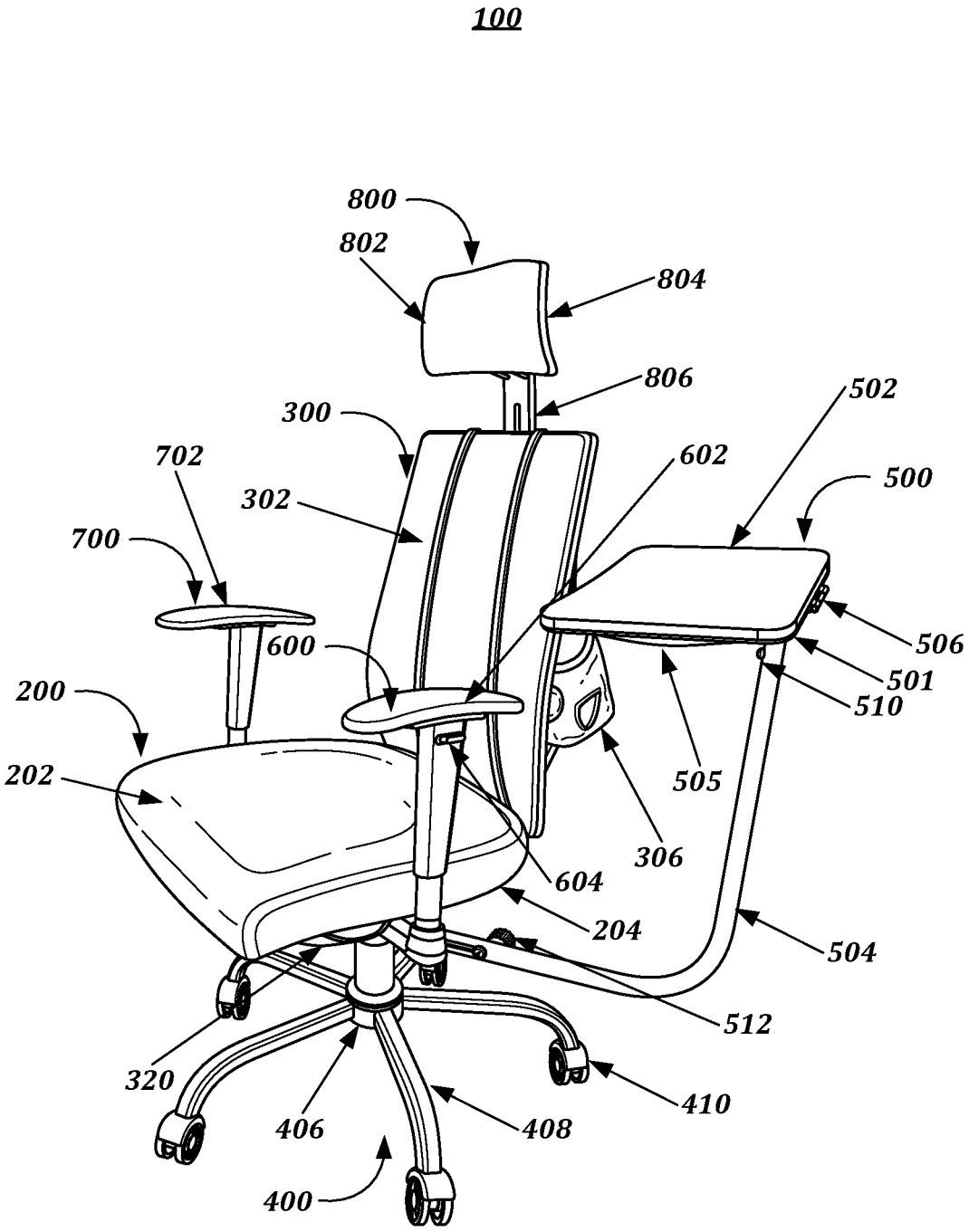
FIG. 1 illustrates a chair apparatus 100.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of chairs, tables, and workstations, embodiments of the present disclosure are not limited to use only in this context.

I. APPARATUS OVERVIEW

This overview is provided to introduce a selection of concepts in a simplified form that are further described below. This overview is not intended to identify key features or essential features of the claimed subject matter. Nor is this overview intended to be used to limit the claimed subject matter's scope.

A chair with a number of aspects and features may be provided. One aspect of the chair may provide a foldable table secured to the chair via a connecting arm. The connecting arm and foldable table may be situated such that it can be rotated completely around the chair uninterrupted by other features of the chair.

The chair may also have a number of pockets disposed on various surface of the chair. Some pockets may be disposed on the underside of the chair's seat. These pockets may be dimensioned and used for storing various handheld electronic devices and/or other items dimensioned similar in size. The location of these pockets may allow for easy access, as they may be located within arm's reach of a user of the chair. Another pocket may be located on a bottom portion of the aforementioned table. This pocket may be expandable as to secure any items in the pocket when the table is being folded or unfolded. Another pocket may be located on a back side of a back support of the chair. This pocket may be used for storing a power source such as a rechargeable battery for charging various electronic devices.

Embodiments of the present disclosure may comprise methods, systems, and components comprising, but not limited to, at least one of the following:

A. A Seat 200;

B. A Back Support 300;

C. A Chair Base 400;

D. A Table System 500;

In some embodiments, the present disclosure may provide an additional set of components for further facilitating the system. The additional set of components may comprise, but not be limited to:

E. A Left Arm Support 600;

F. A Right Arm Support 700; and

G. A Headrest 800.

Details with regards to each component are provided below. Although components are disclosed with specific functionality, it should be understood that functionality may be shared between components, with some functions split between components, while other functions duplicated by the components. Furthermore, the name of the component should not be construed as limiting upon the functionality of the component. Moreover, each stage disclosed within each component can be considered independently without the context of the other stages within the same component or different components. Each stage may contain language defined in other portions of this specifications. Each stage disclosed for one component may be mixed with the operational stages of another component. In the present disclosure, each stage can be claimed on its own and/or interchangeably with other stages of other components.

The following depicts an example of a method of a plurality of methods that may be performed by at least one of the aforementioned components. Various hardware components may be used at the various stages of operations disclosed with reference to each component. For example, although methods may be described to be performed by a single apparatus, it should be understood that, in some embodiments, different operations may be performed by different apparatuses in operating in conjunction with each other. For example, the chair apparatus may be employed in the performance of some or all of the stages disclosed with regard to the methods. Similarly, one apparatus may be employed in the performance of some or all of the stages of the methods. As such, the apparatus may comprise at least one of the architectural components disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Consistent with embodiments of the present disclosure, a method may be performed by at least one of the aforementioned components. The method may be embodied as, for example, but not limited to, computer instructions, which when executed, perform the method. The method may comprise the following stages:

providing a seat portion 200, the seat portion comprising a top portion 202, and a bottom portion 204;

securing a structural portion 304 of a back support 300 to a bottom portion 204 of the seat portion 200, the back support 300 comprising a back support pocket 306 housing a power source 308;

securing a headrest support portion 804 of a headrest 800 to the structural portion 304 of the back support 300;

securing a left arm support 600 to a left portion of the bottom portion 204 of seat 200;

securing a right arm support 700 to a right portion of the bottom portion 204 of seat 200;

securing a chair base 400 to the bottom portion 204 of the seat 200, via the bottom portion 204 of the seat 200 receiving at least a portion of a cylinder module 402; and securing a table system 500 to the chair base 400, the securing comprising rotatably connecting a portion of table arm 504 to a portion of cylinder module 402 such that the table system 500 is capable of uninterrupted rotational lateral movement around the seat portion 200.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

II. SYSTEM CONFIGURATION

One possible embodiment of a component of the apparatus 100 may be provided by the L2 Furniture™ suite of products and services provided by L2 Furniture LLC.

It is noted that the term "item" or "items" may include any suitable object a user of the apparatus may use such as, but not limited to, for example, a computer, a laptop, a phone, desk supplies, a battery, a charger, any suitable electronic device, and/or a book.

It is further noted that, in some embodiments, the term "secure," "disposed," and/or "connected" may be actualized by way of suitable fasteners, securing means, and/or fastening means.

Accordingly, embodiments of the present disclosure provide an apparatus 100 comprised of a distributed set of components, including, but not limited to:

A. Seat 200

At least FIGS. 1-6 illustrate a seat 200 consistent with embodiments of the disclosure.

In some embodiments, seat 200 may comprise a top portion 202, illustrated at least in FIG. 1. The top portion 202 may be used to receive a buttock of a user. The top portion 202 may be embodied as, but not limited to, a cushion and/or pad. In some embodiments, top portion 202 may be malleable, rigid, semirigid, and/or any combination thereof.

In further embodiments, seat 200 may comprise a bottom portion 204, illustrated at least in FIG. 1. The bottom portion 204 may be used to receive various components of the apparatus 100. In some embodiments, the bottom portion 204 may comprise a cylinder receiving portion 205 and/or one or more apertures. The cylinder receiving portion 205 and/or the one or more apertures may be used to receive at least a portion of cylinder module 402. The bottom portion 204 may provide structural support for the seat 200 and various components thereof. In some embodiments, bottom portion 204 may be malleable, rigid, semirigid, and/or any combination thereof.

It is noted that, in some embodiments, the top portion 202 and the bottom portion 204 may collectively be formed as one unitary component (and/or referred to collectively as "seat 200") comprising at least a portion of the features of the top portion 202 and the bottom portion 204. The top portion 202 and/or the bottom portion 204 may be oriented substantially horizontally (and/or parallel to a floor and/or surface on which the apparatus 100 is oriented).

Figure 5:
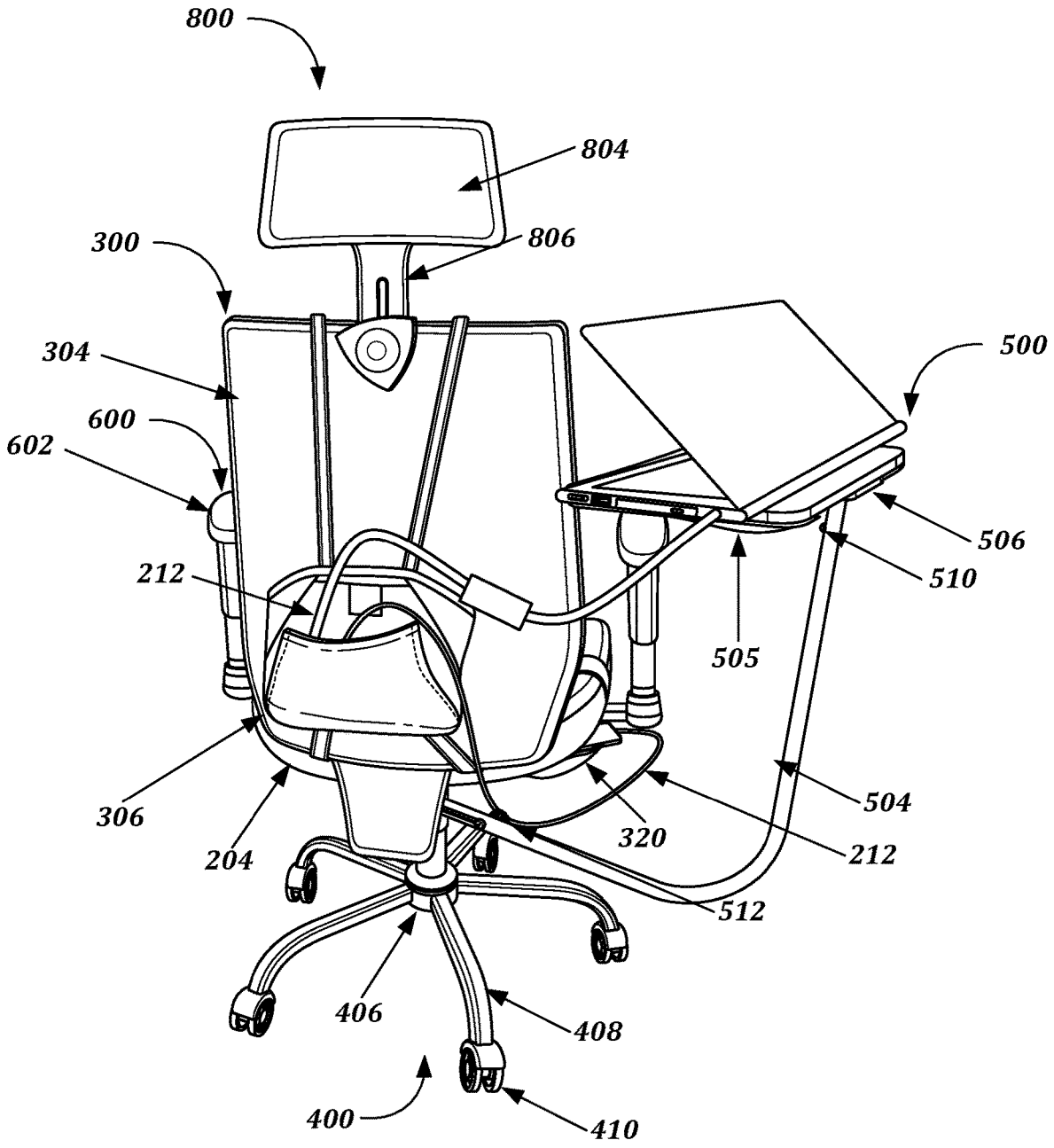
FIG. 5 is a back view of the chair apparatus 100 showing one or more back support pockets 306.

In further embodiments, seat 200 may comprise one or more charging components 212, illustrated at least in FIG. 5. The one or more charging components 212 may be used to charge one or more electronic devices. The one or more charging components 212 may be configured to secure to a power source 308 such that an electrical current may flow and/or channel from the power source 308, through the one or more charging components 212, to the one or more electronic devices or vice versa. The one or more charging components 212 may further be used to charge the power source 308 via an external power source (not shown). In some embodiments, the one or more charging components 212 may comprise one or more of a power outlet, an inductive charging pad, a bus connector (e.g. a Universal Serial Bus connector), and/or any other component configured to charge an electronic device (not shown).

In further embodiments, seat 200 may comprise one or more seat pockets 202, illustrated at least in FIG. 1. The one or more seat pockets 202 may be used to house and/or secure various items such as, but not limited to, a smartphone. The one or more seat pockets 202 may be secured to the bottom portion 204. The one or more seat pockets 202 may be disposed below bottom portion 204. In further embodiment, the one or more seat pockets may be disposed adjacent to a left arm support 600 and/or a right arm support 700. In some embodiments, the one or more charging components 212 may be accessible using at least one of the one or more seat pockets 202.

B. Back Support 300

At least FIGS. 1-6 illustrate back support 300 consistent with embodiments of the disclosure. The back support 300 may be used to receive and/or contact at least a portion of a back of the user and/or provide lumbar support of the user. The back support 300 may be operatively secured to the seat portion. The back support 300 may be configured to axially rotate (e.g., recline) about a y-axis axis defined by, in some embodiments, a junction of the back support 300 and the seat 200.

In some embodiments, the back support 300 may comprise a back support cushion 302, illustrated at least in FIG. 1. The back support cushion 302 may be used to provide comfort to the back of the user.

In further embodiments, the back support 300 may comprise a back support structural portion 304, illustrated at least in FIG. 1. The back support structural portion 304 may be used to provide a frame and/or structure to the back support 300. The back support structural portion 304 may be secured to the back support cushion 302 such that the back support structural portion 304 faces away from the seat 200 and the back support cushion 302 faces the top portion 202 of the seat 200.

In further embodiments, the back support 300 may comprise one or more back support pockets 306. The one or more back support pockets 306 may temporarily and/or permanently house one or more items substantially dimensioned the size of the one or more pockets 306 and/or smaller. It is noted that any of the aforementioned and proceeding pockets may be retractably expandable to assist in securing the housed items in said pockets.

In further embodiments, the back support 300 may comprise the power source 308, illustrated at least in FIG. 1. The power source 308 may be used to provide electrical output and/or to power and/or charge various electronic devices (e.g., via the one or more charging components 212). It is noted that in some embodiments, the various electronic devices may be associated with and/or integrated into the apparatus 100. It is further noted that in other embodiments, the various electronic devices may not be associated with and/or not integrated into (i.e., "external to") the apparatus 100. By way of nonlimiting example, the power source 308 may be embodied as a (rechargeable or non-rechargeable) battery, a fuel cell, a connection to a power main, and/or any other source of electrical power. In further embodiments, the power source 308 may be housed in and/or on the one or more back support pockets 306.

Figure 3:
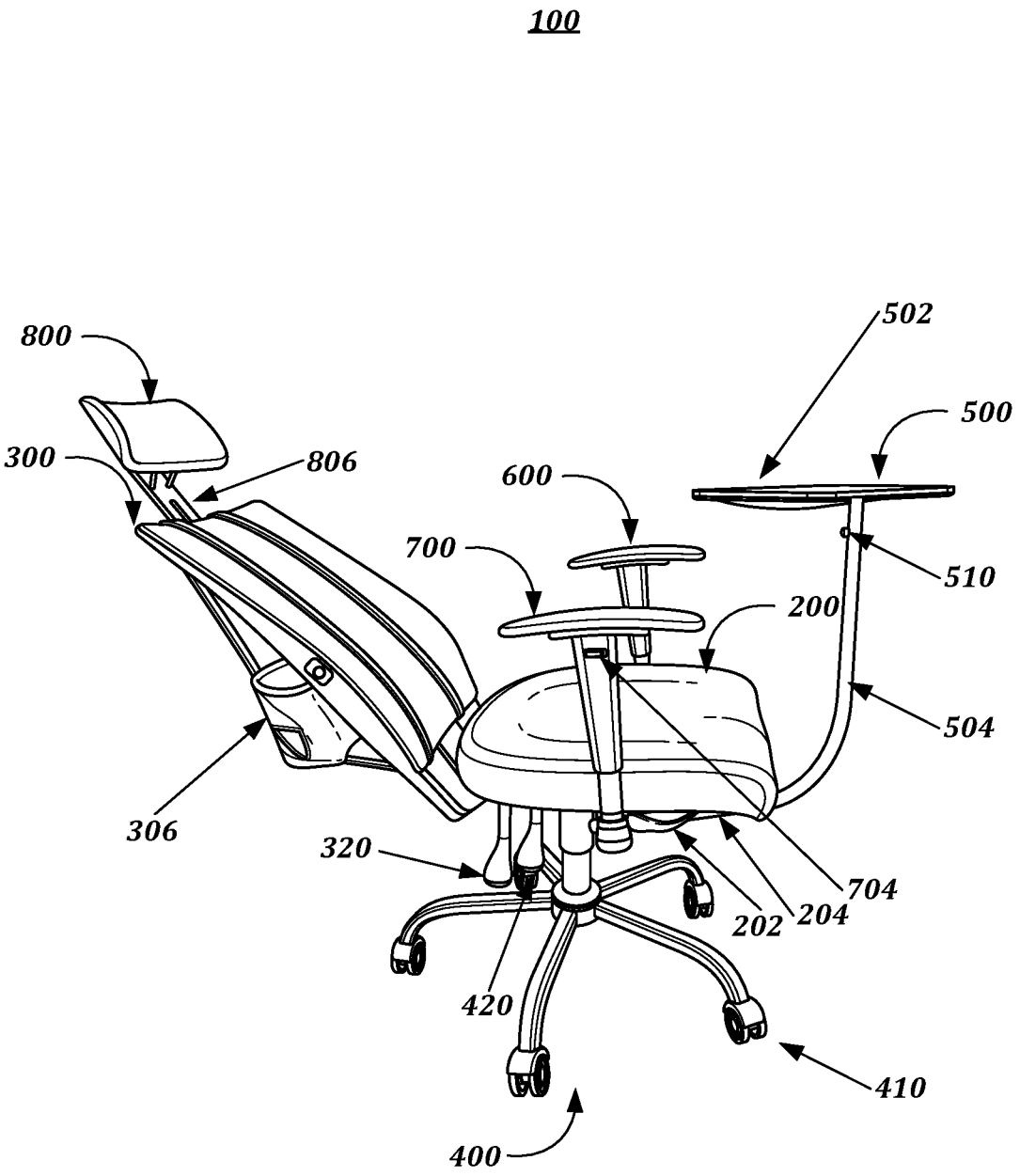
FIG. 3 is another view of the chair apparatus 100 with a back support 300 in a reclined position.
Figure 4B:
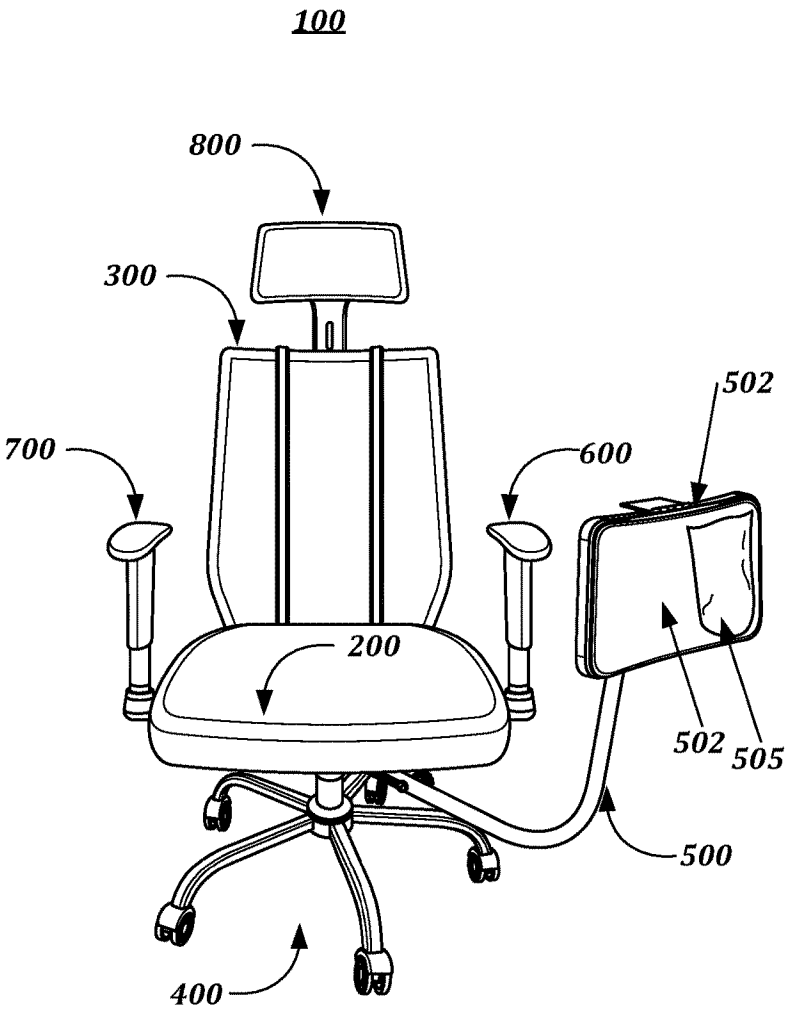
FIG. 4B is another view of the chair apparatus 100 with the planar surface 502 of the table portion 500 in a folded position 501.
Figure 4A:
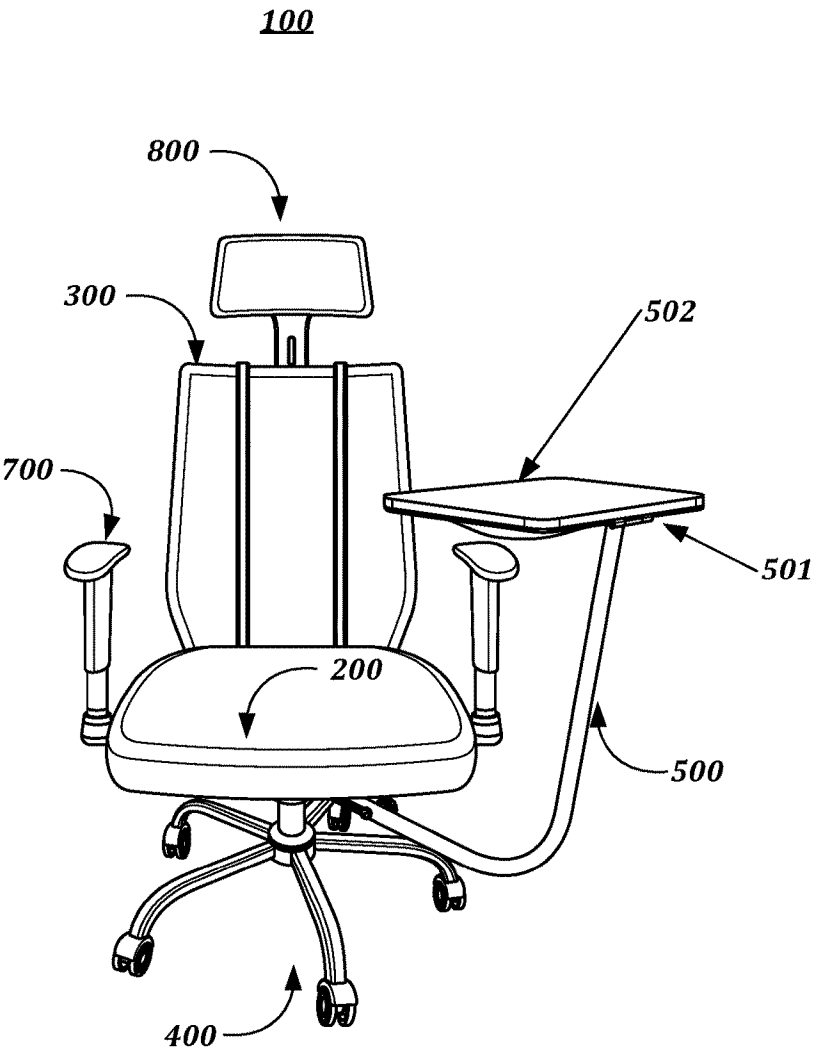
FIG. 4A is another view of the chair apparatus 100 with a planar surface 502 of a table portion 500 in an unfolded position 503.

In further embodiments, seat 200 may comprise a back support tilt adjustment lever 320, illustrated at least in FIG. 3. The back support tilt adjustment lever 320 may be used to tilt and/or rotate the back support 300 in an axial fashion for comfort preference of a user. The back support tilt adjustment lever 320 may be secured to and/or through at least a part of the bottom portion 204. In some embodiments, back support tilt adjustment lever 320 may be in operative communication with the back support 300 and/or be configured to actuate via, but not limited to, a plurality of gears and levers.

Figure 6:
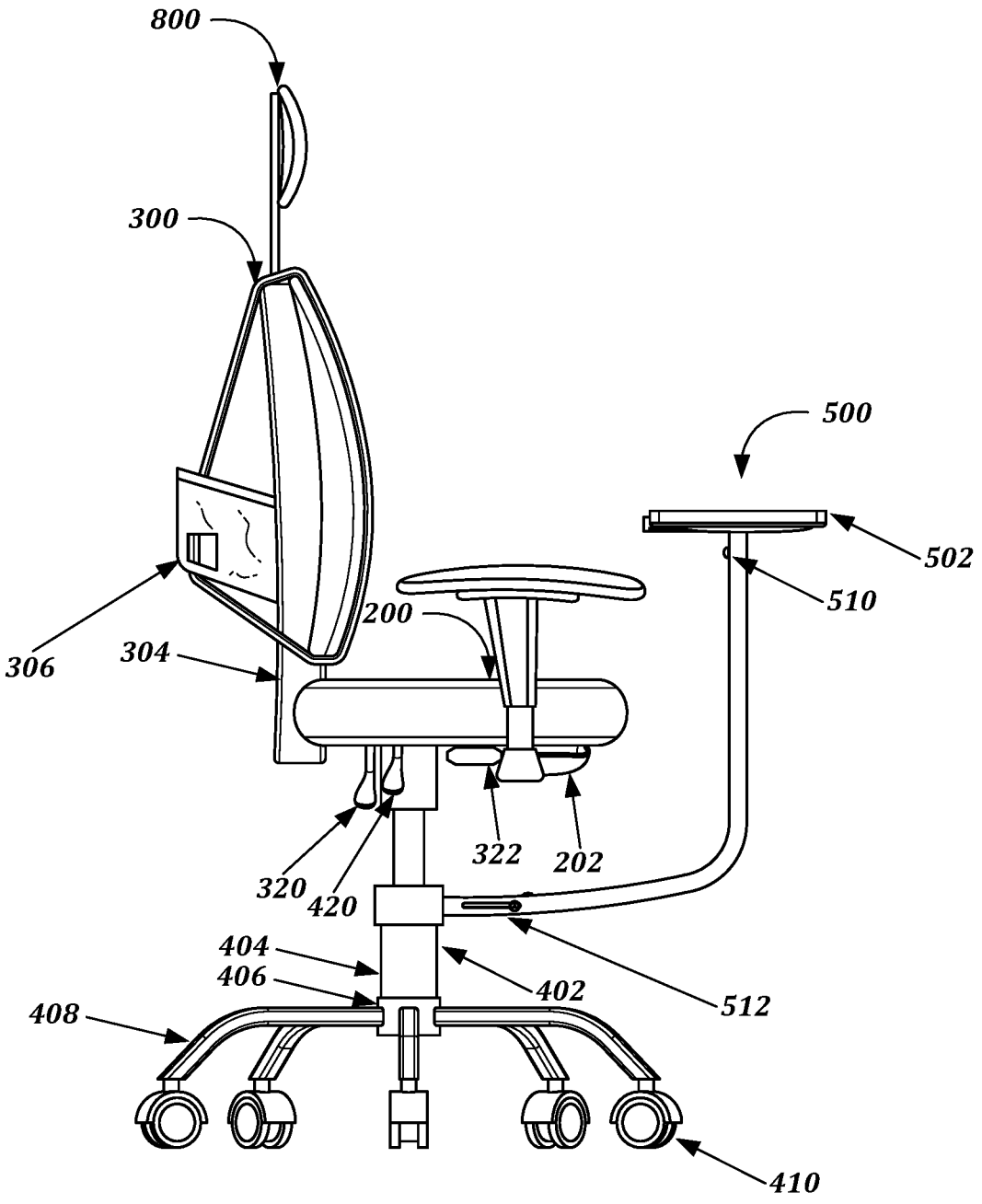
FIG. 6 is another view of the chair apparatus 100.

In further embodiments, back support 300 may comprise a back support tilt tension control lever 322, illustrated at least in FIG. 6. The back support tilt tension control lever 322 may be used to regulate the ease with which the back support can be tilted and/or position adjusted. The back support tilt tension control lever 322 may be secured to and/or through at least a part of the bottom portion 204. In some embodiments, back support tilt tension control lever 322 may be in operative communication with the back support 300 and/or be configured to actuate via, but not limited to, a plurality of gears and levers. The back support tilt tension control lever 322 may be embodied as, but not limited to, a substantially circular dial.

C. Chair Base 400

At least FIGS. 1-6 illustrate the chair base 400 consistent with embodiments of the disclosure.

In some embodiments, the chair base 400 may comprise a cylinder module 402, illustrated at least in FIG. 6. The cylinder module 402 may be used to secure the chair base 400 to the seat 200. The cylinder module 402 may be further used to adjust the height of the apparatus 100. In some embodiments, the cylinder module 402 may be embodied as, but not limited to, for example, a gas cylinder operated by and in operative communication with, the seat height adjustment lever 420. To further the non-limiting example, the cylinder module 402 may comprise an inner cylinder, an outer gas cylinder housing a gaseous mixture and the inner cylinder, a piston connecting rod, a rubber buffer, a bearing support, a bottom valve, a switch pin, an O-ring and/or an internal bracket (not shown). In other embodiments, the cylinder module 402 may be embodied as, but not limited to, for example, a single rod, shaft, and/or structural component, height adjustable and non-height adjustable.

In further embodiments, the chair base 400 may comprise a cylinder cover 404, illustrated at least in FIG. 6. The cylinder cover 404 may be configured to envelop at least a portion of the cylinder module 402. The cylinder cover 404 may be used to provide a layer of protection from external elements.

In further embodiments, the chair base 400 may comprise a cylinder base 406, illustrated at least in FIG. 6. The cylinder base 406 may be used to secure the cylinder module to one or more legs 408.

In further embodiments, the chair base 400 may comprise the one or more legs 408, illustrated at least in FIGS. 1-6. The one or more legs 408 may be used to provide stability to the apparatus 100. The one or more legs 408 may be configured to receive one or more casters, one or more wheels, and/or one or more stoppers. In some embodiments, the one or more legs 408 may be configured to secure to the cylinder base 406.

In further embodiments, the chair base 400 may comprise one or more casters 410. The one or more casters 410 may be used to provide horizontal mobility and/or rollability to the apparatus 100. In some embodiments, each of the one or more casters 410 may comprise a wheel. In further embodiments, each of the one or more casters 410 may comprise a wheel mounting frame. The wheel mounting frame may be configured to secure to the one or more legs 408. The wheel mounting frame may further be configured to receive the wheel.

In further embodiments, seat 200 may comprise a seat height adjustment lever 420, illustrated at least in FIG. 3. The seat height adjustment lever 420 may be used to adjust and/or modify the height of the seat 200 in relation to the chair base 400. The seat height adjustment lever 420 may be secured to and/or through at least a part of the bottom portion 204. In some embodiments, seat height adjustment lever 420 may be in operative communication with the seat 200 and/or be configured to actuate via, but not limited to, one or more pistons (gas powered and/or hydraulic), one or more gears, and/or one or more levers.

D. Table System 500

At least FIGS. 1-6 illustrate table system 500 consistent with an embodiment of the disclosure. The table system 500 may be used to provide a surface to place items on and/or to store items in.

In some embodiments, the table system 500 may comprise a planar surface 502, illustrated at least in FIGS. 1-5. In some embodiments, the planar surface 502 may be configured for a folded position 501 and/or an unfolded position 503, illustrated at least in FIGS. 4A-4B. In the folded position 501, the planar surface may be oriented substantially vertically (and/or orthogonally to the top portion 202 and/or bottom portion 204 of the seat 200). In the unfolded position 503, the planar surface may be oriented substantially horizontal (and/or parallel to the top portion 202 and/or bottom portion 204 of seat 200). In other embodiments, in the unfolded position 503, the planar surface may be oriented substantially nonorthogonal to the seat 200. The planar surface 502 may be used, in the unfolded position, as a workspace and/or means to connect and/or place items on a top portion of the planar surface 502. In further embodiments, the planar surface 502 may comprise a table pocket 505, illustrated at least in FIGS. 1-5. The table pocket 505 may be disposed on a bottom portion of the planar surface 504.

In further embodiments, the table system 500 may comprise a table arm 504, illustrated at least in FIGS. 1-5. The table arm 504 may be used to orient the planar surface at a predetermined height and distance from the seat 200 for ease of use and/or access by the user.

Figure 7B:
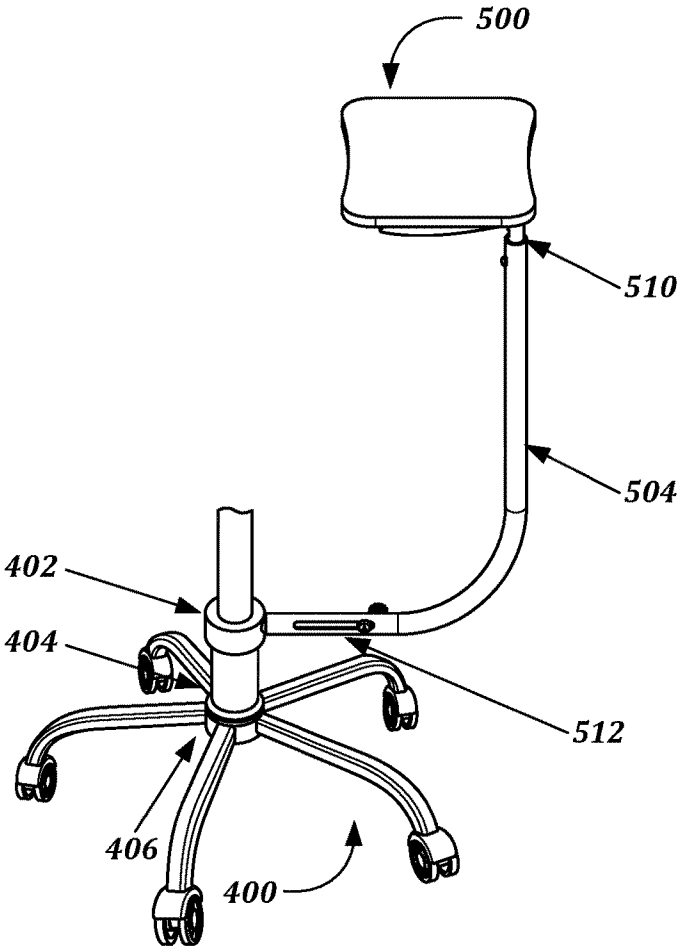
FIG. 7B illustrates the table portion 500 in an extended state.
Figure 7A:
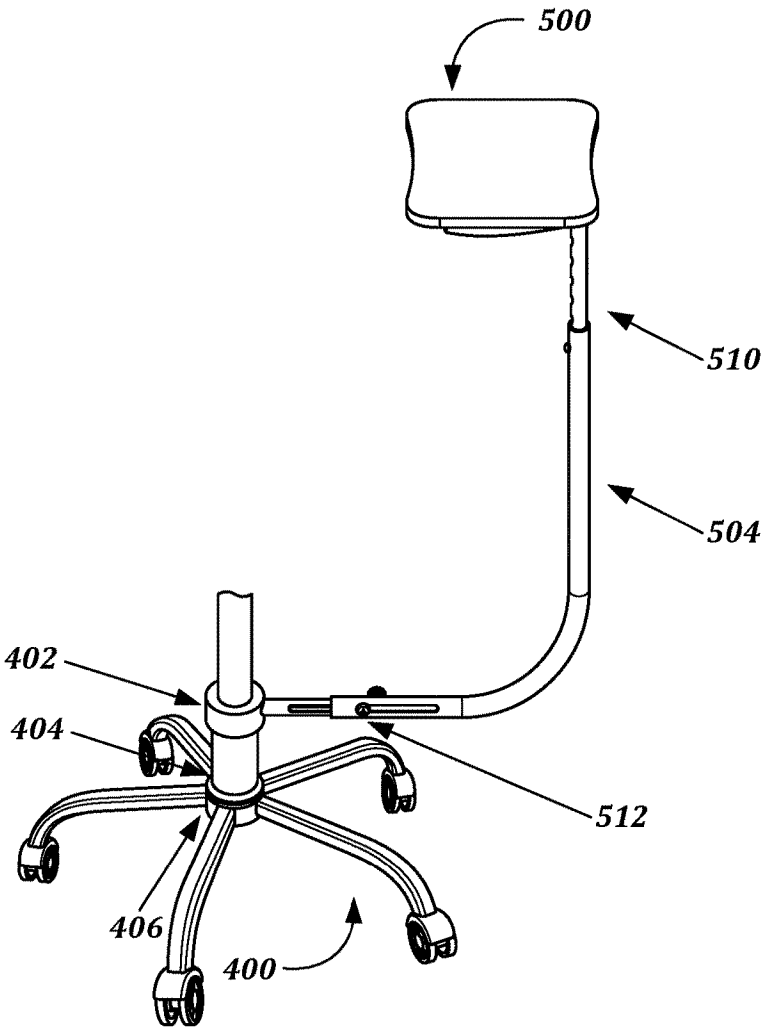
FIG. 7A illustrates the table portion 500 in a retracted state.
Figure 8:
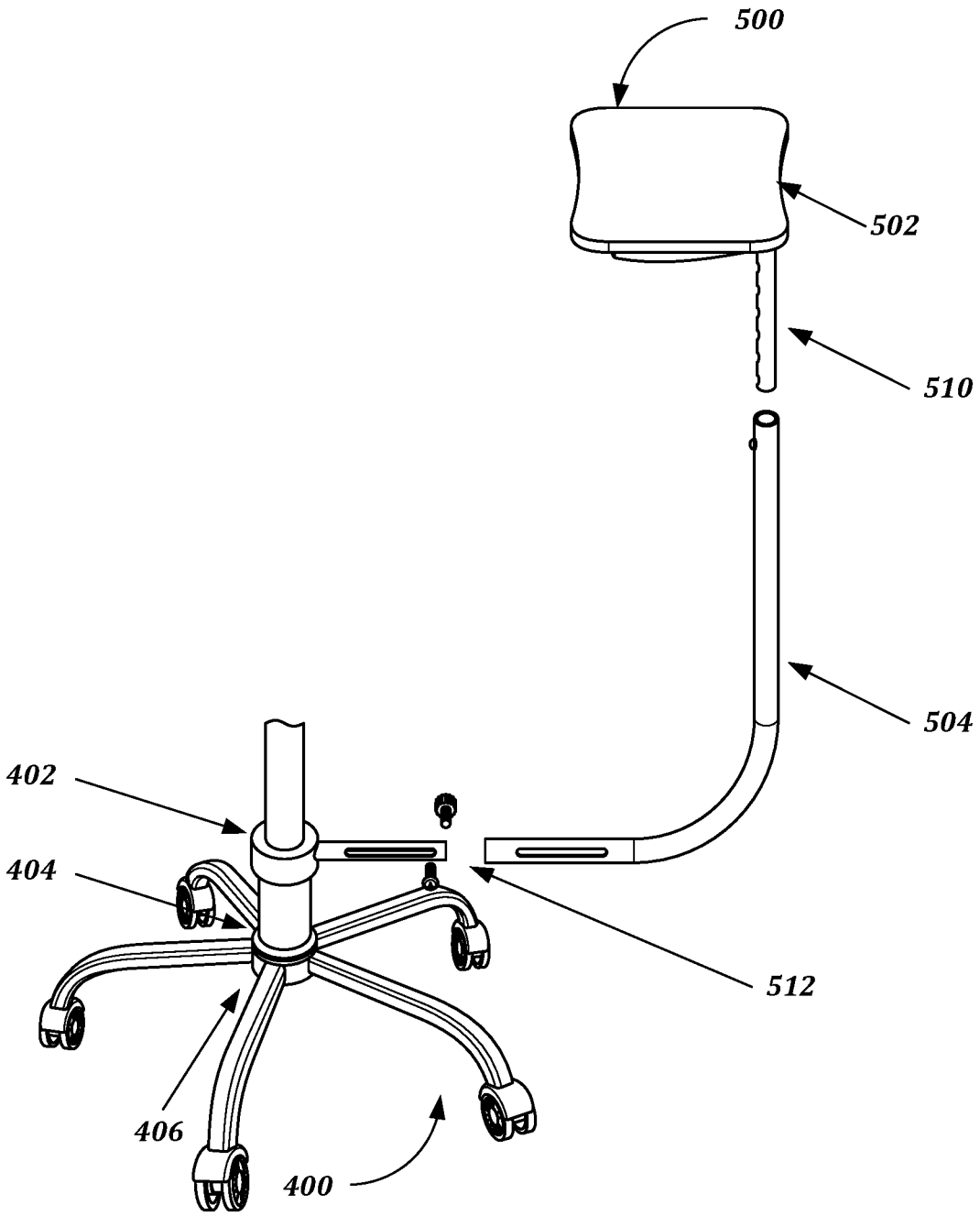
FIG. 8 illustrates an exploded view of the table portion 500.

The table arm 504 may comprise a swivel portion 508 on a first distal end, illustrated at least in FIGS. 6-8. The swivel portion 508 may allow for an unobstructed three hundred and sixty degree (and/or lateral rotation) around the cylinder module 402, the seat 200, the back support 300, and/or any other components of the apparatus 100. The swivel portion 508 may be revolvably secured to a portion of the cylinder module 402, the cylinder cover 404, and/or the bottom portion 204. In some embodiments, at least a portion of the table arm 504 may form a substantially right angle.

In some embodiments, the table arm 504 may comprise a height adjustor 510. The height adjustor 510 may be used to adjust vertical and/or y-axis orientation of the arm in relation to the apparatus 100 and/or a user of the apparatus 100. In some embodiments, the height adjustor 510 may have one or more telescopic portions with a tension means and/or pin in order to secure the table arm 504 at a determined height.

In some embodiments, the table arm 504 may comprise a length adjustor 512. The length adjustor 512 may be used to adjust horizontal and/or x-axis orientation of the arm in relation to the apparatus 100 and/or the user of the apparatus 100. In some embodiments, the length adjustor 512 may have another telescopic portion(s) with a combination of rods and/or fastening means to secure the table arm 504 at a determined length.

Figure 9:
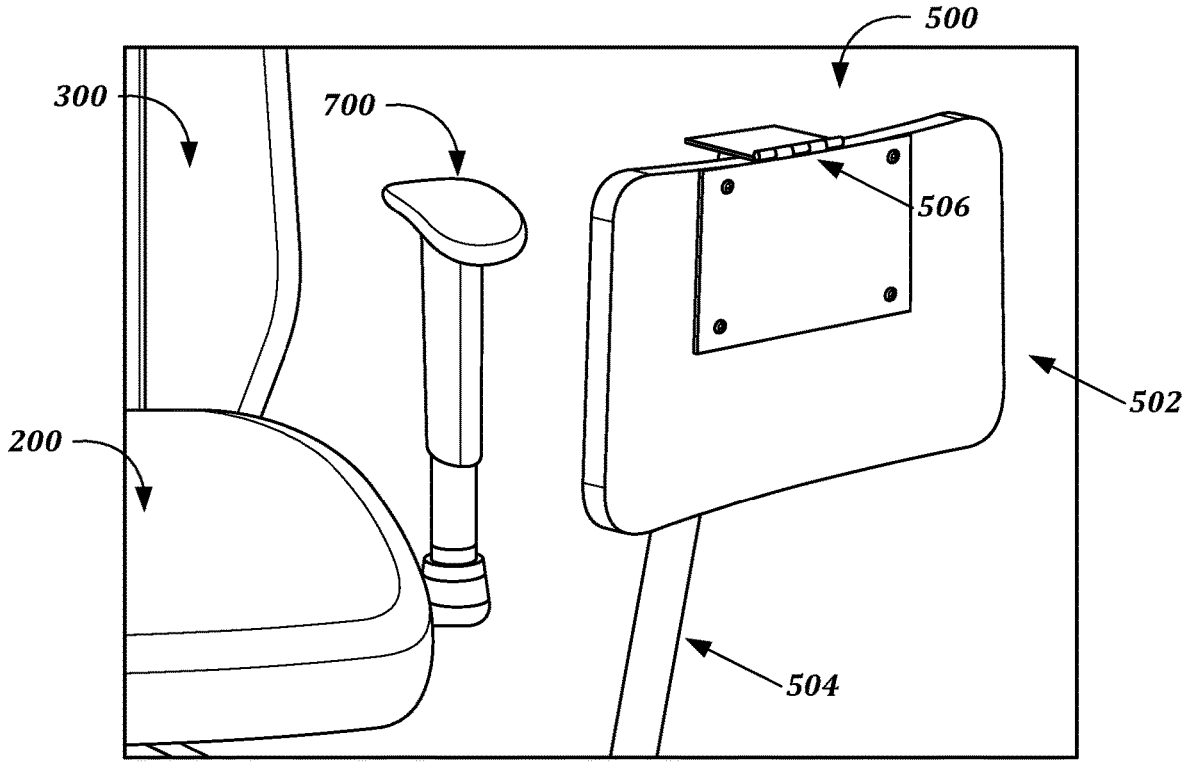
FIG. 9 illustrates the planar surface 502 of the table portion 500 in the folded position 501.
Figure 10:
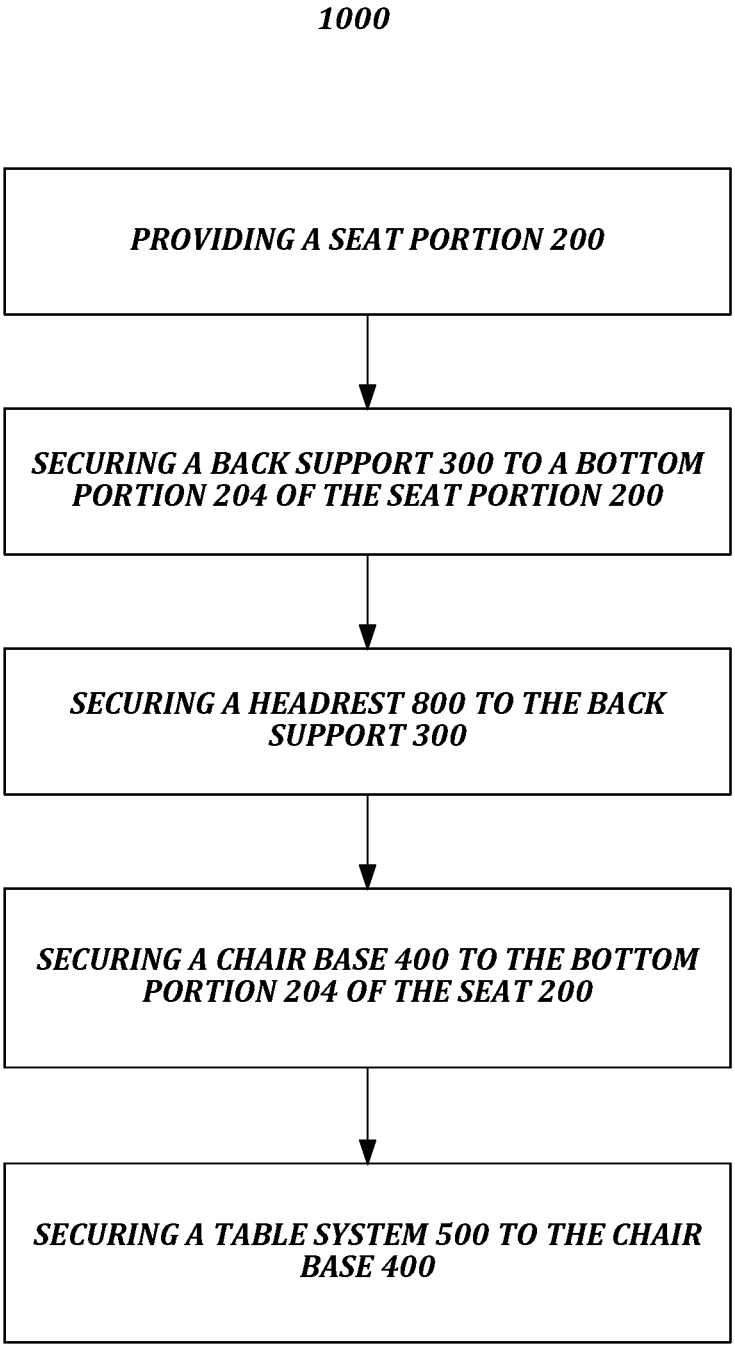
FIG. 10 illustrates a method 1000 for assembling a chair apparatus 100.

In further embodiments, the table arm 504 may comprise a hinge 506 on a second distal end, illustrated at least in FIGS. 1 and 9. The hinge 506 may be used to secure the planar surface to the table arm 504. The hinge 506 may be configured to allow axial rotation of the planar surface 502 to move between the folded position 501 and the unfolded position 503. The hinge 506 may be further configured to allow the planar surface to move from the folded position 501 to the unfolded position 503 and vice versa. In embodiments, the hinge may be configured to lock or otherwise retain the planar surface 502 in the folded position 501 and/or the unfolded position 503.

E. Left Arm Support 600

At least FIGS. 1-5 illustrate left arm support 600 consistent with embodiments of the disclosure. The left arm support 600 may be used to support an arm of the user. The left arm support 600 may be disposed on a left side of the seat 200. The left arm support 600 may be secured to a left portion of the bottom portion 204 of seat 200.

In some embodiments, the left arm support 600 may comprise a left arm support cushion 602, illustrated at least in FIG. 1. The left arm support cushion 602 may be configured to receive the arm, elbow, and/or hand of the user.

In further embodiments, the left arm support 600 may comprise a left arm support height adjustment portion 604, illustrated at least in FIG. 1. The left arm support height adjustment portion 604 may comprise a lever for height adjustment of the left arm support 600. In further embodiments, the left arm support cushion 602 may be configured to be horizontally and/or pivotably adjustable.

F. Right Arm Support 700

At least FIGS. 1-6 illustrate right arm support 700 consistent with embodiments of the disclosure. The right arm support 700 may be used to support an arm of the user. The right arm support 700 may be disposed on a left side of the seat 200. The right arm support 700 may be secured to a right portion of the bottom portion 204 of seat 200.

In some embodiments, the right arm support 700 may comprise a right arm support cushion 702, illustrated at least in FIG. 1. The right arm support cushion 702 may be configured to receive the arm, elbow, and/or hand of the user.

In further embodiments, the right arm support 700 may comprise a right arm support height adjustment portion 704, illustrated at least in FIG. 3. The right arm support height adjustment portion 704 may comprise a lever for height adjustment of the right arm support 700. In further embodiments, the right arm support cushion 702 may be configured to be horizontally and/or pivotably adjustable.

G. Headrest 800

At least FIGS. 1-6 illustrate headrest 800 consistent with embodiments of the disclosure.

In some embodiments, the headrest 800 may comprise a headrest cushion 802, illustrated at least in FIG. 1. The headrest cushion 402 may be used to receive and/or connect to a head and/or neck of the user.

In further embodiments, the chair base 800 may comprise a headrest support portion 804, illustrated at least in FIG. 1. The headrest support portion 804 may be configured to provide structural support to the headrest cushion 402. The headrest support portion 804 may be further configured to receive a headrest connecting portion 806.

Figure 2:
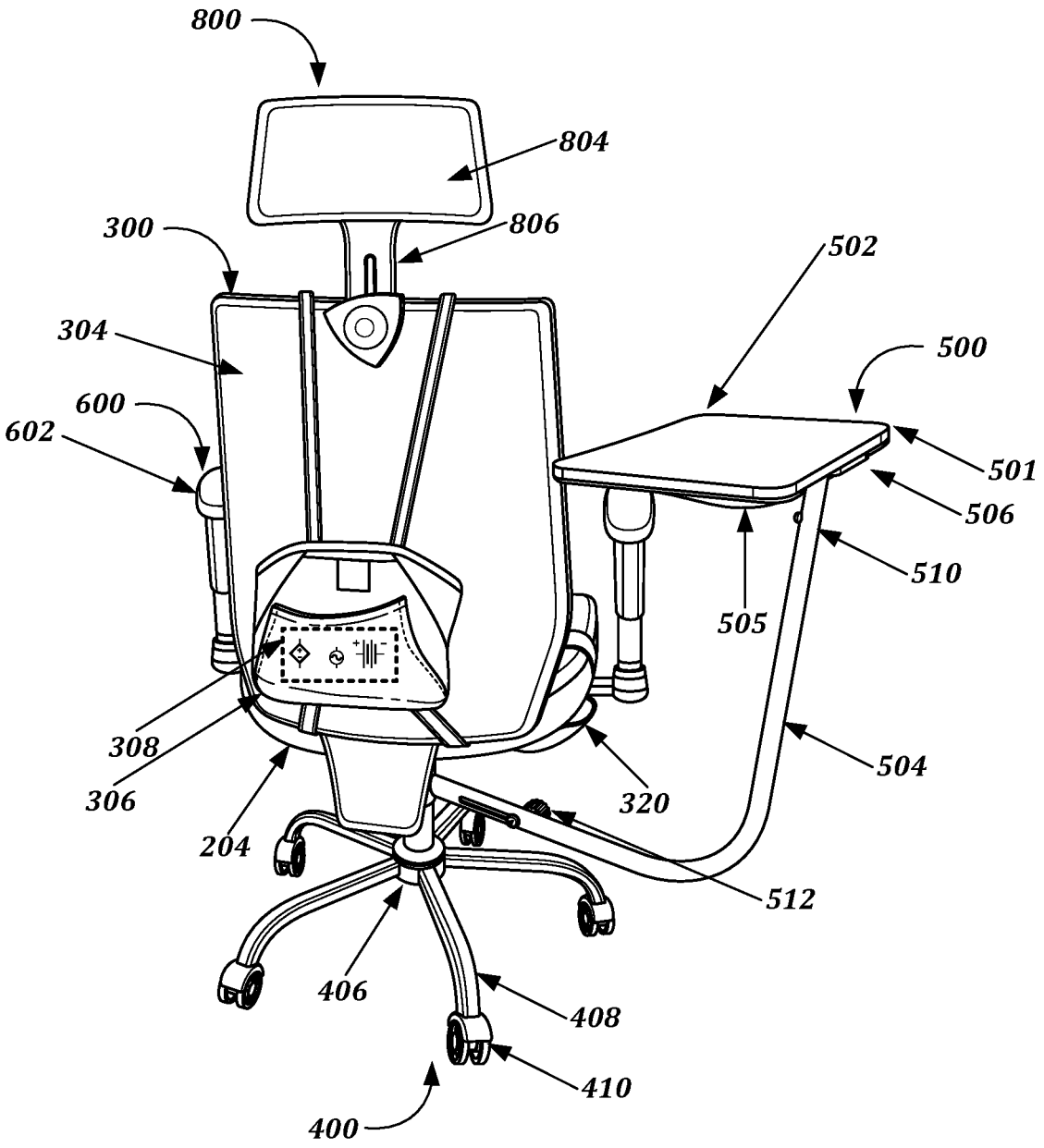
FIG. 2 is another view of the chair apparatus 100.

In further embodiments, the chair base 800 may comprise the headrest connecting portion 806, illustrated at least in FIG. 2. The headrest connecting portion 806 may be configured to secure the headrest 800 to the back support 300. In some embodiments, the headrest 800 may be height-adjustable and/or pivotably adjustable in relation to the back support 300.

III. APPARATUS/SYSTEM USE

Embodiments of the present disclosure provide a system operative by a set of methods comprising instructions configured to operate the aforementioned components in accordance with the methods. The following depicts an example of a method of a plurality of methods that may be performed by at least one of the aforementioned components. Various hardware components may be used at the various stages of operations disclosed with reference to each component.

For example, although methods may be described to be performed by a single component, it should be understood that, in some embodiments, different operations may be performed by different components in operative relation with one another. For example, an apparatus may be employed in the performance of some or all of the stages disclosed with regard to the methods. As such, the apparatus may comprise at least one architectural component disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

Consistent with embodiments of the present disclosure, a method 1000 for assembling a chair apparatus 100 may be performed by at least one of the aforementioned components. The method may comprise the following stages:

1. Providing a seat portion 200,
   a. The seat portion comprising a top portion 202, and a bottom portion 204;
2. Securing a (structural portion 304 of a) back support 300 to a bottom portion 204 of the seat portion 200;
   a. (Optional) the back support 300 comprising a back support pocket 306 housing a power source 308;
3. Securing a (headrest support portion 804 of a) headrest 800 to the (structural portion 304 of the) back support 300;
4. (Optional) securing a left arm support 600 to a left portion of the bottom portion 204 of seat 200;
5. (Optional) securing a right arm support 700 to a right portion of the bottom portion 204 of seat 200;
6. Securing a chair base 400 to the bottom portion 204 of the seat 200,
   a. Via the bottom portion 204 of the seat 200 receiving at least a portion of a cylinder module 402;
7. Securing a table system 500 to the chair base 400,
   a. The securing comprising rotatably connecting a portion of table arm 504 to a portion of cylinder module 402 such that the table system 500 is capable of uninterrupted rotational lateral movement around the seat portion 200 (the back support portion 300, and/or the chair base 400).

Although the stages are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

IV. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A chair apparatus comprising:

a seat comprising:

a top portion configured to contact at least a portion of a user of the chair apparatus, and a bottom portion;

a back support secured to the bottom portion of the seat, the back support configured to contact at least a portion of the user of the chair apparatus;

a chair base comprising:

a cylinder, a first end of the cylinder securing to the bottom portion of the seat, a cylinder base secured to a second end of the cylinder, and one or more legs secured to the cylinder base, the one or more legs being configured to support the chair apparatus and to contact an operable surface for use of the chair apparatus;

a table system comprising:

a table arm revolvably secured to the cylinder such that the table arm is configured to axially rotate independently and undisturbed around the seat and the back support, and a table portion hingedly connected to the table arm and positioned above the top portion of the seat;

a first pocket disposed on a bottom side of the table portion; and a second pocket disposed on the bottom portion of the seat.

2. The chair apparatus of claim 1, wherein the table system comprises a folded configuration and an unfolded configuration.

3. The chair apparatus of claim 2, wherein in the folded configuration, the table portion is folded downward such that a planar surface of the table portion is oriented substantially orthogonal to the chair base, wherein in the unfolded configuration, the table portion is mounted on a flat portion of the table arm such that a planar surface of the table portion is oriented substantially nonorthogonal to the chair base.

4. The chair apparatus of claim 2, wherein in the unfolded configuration, the table portion is mounted on a flat portion of the table arm such that a planar surface of the table portion is oriented substantially parallel to the chair base, wherein in the folded configuration, the table portion is folded downward such that the planar surface of the table portion is oriented substantially orthogonal to the chair base.

5. The chair apparatus of claim 4, wherein the table arm comprises:

a table system height adjustor configured to adjust vertical orientation of the table system in relation to the seat and the back support, and a table system length adjustor configured to adjust horizontal orientation of the table system in relation to the seat and the back support.

6. The chair apparatus of claim 1, further comprising:

a headrest portion secured to the back support, a right arm support configured to support a right arm of the user, the right arm support secured to a right side of the bottom portion of the seat, and a left arm support configured to support a left arm of the user, the left arm support secured to a left side of the bottom portion of the seat.

7. The chair apparatus of claim 1, further comprising:

a back support tilt adjustment lever secured to the bottom portion of the seat, the back support tilt adjustment lever being configured to tilt the back support in an axial manner, and a seat height adjustment lever secured to the bottom portion of the seat, the seat height adjustment lever being configured to adjust a vertical orientation of the seat.

8. The chair apparatus of claim 1, further comprising one or more casters, each of the one or more casters being secured to a leg of the one or more legs, wherein each of the one or more casters comprises:

a wheel mounting frame, and a wheel rotatably secured to the wheel mounting frame.

9. The chair apparatus of claim 1, further comprising a pocket disposed on a back side of the back support, the pocket housing a power source configured to provide electrical output to one or more external electronic devices.

10. A chair apparatus comprising:

a seat secured to a back support, the seat and the back support each configured to contact at least a portion of a user of the chair apparatus;

a chair base secured to the seat, the chair base comprising:

one or more legs configured to support the chair apparatus and to contact an operable surface for use of the chair apparatus, and a table system comprising:

a table arm revolvably secured to the chair base such that the table arm is configured to axially rotate undisturbed around the seat, and a table portion hingedly connected to the table arm and positioned above the seat;

a first pocket disposed on a bottom side of the table portion; and a second pocket disposed on a bottom portion of the seat;

wherein the back support comprises a power source configured to provide electrical output to one or more external electronic devices.

11. The chair apparatus of claim 10, wherein the chair base further comprises a gas cylinder configured to adjust a distance between the chair base and the operable surface.

12. The chair apparatus of claim 10, wherein the table system comprises a folded configuration and an unfolded configuration.

13. The chair apparatus of claim 12, wherein in the unfolded configuration, the table portion is mounted on a flat portion of the table arm such that a planar surface of the table portion is oriented substantially parallel to the chair base, wherein in the folded configuration, the table portion is folded downward such that the planar surface of the table portion is oriented substantially orthogonal to the chair base.

14. A chair apparatus comprising:

a seat comprising:

a top portion configured to contact at least a portion of a user, and a bottom portion;

a back support secured to the bottom portion of the seat;

a chair base comprising:

a gas cylinder, a first end of the gas cylinder securing to the bottom portion of the seat, a cylinder base secured to a second end of the gas cylinder, a cylinder cover enveloping at least a portion of the gas cylinder, and one or more legs secured to the cylinder base; and a table system comprising:

a table arm revolvably secured to the cylinder cover such that the table arm is configured to axially rotate undisturbed around the seat and the back support, the table arm comprising:

a telescoping table system height adjustor configured to adjust vertical position of the table system in relation to the seat and the back support, a telescoping table system length adjustor configured to adjust horizontal position of the table system in relation to the seat and the back support, and a table portion hingedly connected to the table arm and positioned above the top portion of the seat.

15. The chair apparatus of claim 14, further comprising a pocket disposed on a back side of the back support, the pocket housing a power source configured to provide electrical output to one or more external electronic devices.

16. The chair apparatus of claim 14, further comprising:

a first pocket disposed on a bottom side of the table portion, and a second pocket disposed on the bottom portion of the seat.

17. The chair apparatus of claim 14, wherein the table system comprises a folded configuration and an unfolded configuration.

18. The chair apparatus of claim 17, wherein in the unfolded configuration, the table portion is mounted on a flat portion of the table arm such that a planar surface of the table portion is oriented substantially nonorthogonal to the chair base, wherein in the folded configuration, the table portion is folded downward such that the planar surface of the table portion is oriented substantially orthogonal to the chair base.

* * * * *